US006045085A

United States Patent [19]

Andersson et al.

[11] Patent Number: 6,045,085

[45] Date of Patent: Apr. 4, 2000

[54] ADHESIVE DISPENSING DEVICE IN A REEL-UP IN A PAPER MACHINE

[75] Inventors: Tommy Göran Andersson; Åke Tomas Eklund; Rolf Gunnar Lind; Tord Olof Sixten Svanqvist, all of Karlstad, Sweden

[73] Assignee: Valmet-Karlstad AB, Sweden

[21] Appl. No.: 09/061,832

[22] Filed: Apr. 16, 1998

Related U.S. Application Data

[60] Provisional application No. 60/049,251, Jun. 10, 1997.

[30] Foreign Application Priority Data

Apr. 16, 1997 [SE] Sweden ..... 9701401

[51] Int. Cl.[7] ..... B65H 75/28; B65H 71/00

[52] U.S. Cl. ..... 242/532.3; 242/548; 242/908

[58] Field of Search ..... 242/532.3, 532.2, 242/908, 548; 156/527

[56] References Cited

U.S. PATENT DOCUMENTS

| | | | |
|---|---|---|---|
| 5,009,736 | 4/1991 | Lehto | 242/532.3 |
| 5,213,649 | 5/1993 | Sepavich et al. | 156/380.7 |
| 5,614,059 | 3/1997 | Boriani et al. | 156/509 |
| 5,730,387 | 3/1998 | Yamazaki | 242/532.3 |

FOREIGN PATENT DOCUMENTS

| | | |
|---|---|---|
| 0 765 832 A2 | 4/1997 | European Pat. Off. . |
| 40 03 577 C1 | 4/1991 | Germany . |

*Primary Examiner*—John Q. Nguyen
*Attorney, Agent, or Firm*—Alston & Bird LLP

[57] ABSTRACT

A device is provided in a reel-up in a paper machine in which paper is produced in a web running in the reel-up and supported by a surface winding drum and wound onto exchangeable reeling drums in contact with the surface winding drum in order to form reels of paper. The device applies an adhesive agent on the web when changing full-width reels and in the event of web ruptures in the reel-up. A screen is mounted on the stand of the reel-up, upstream of the surface winding drum, and extending transversely to the machine direction. A spray rack, supported by the screen, extends transversely to the web across its entire width and comprises a plurality of nozzles distributed uniformly across the web to spread spray jets of liquid containing said adhesive agent onto the web to form a coherent adhesive area perpendicular to the machine direction. The adhesive area is brought into contact with an empty reeling drum or an already commenced reel of paper.

27 Claims, 5 Drawing Sheets

ADHESIVE DISPENSING DEVICE IN A REEL-UP IN A PAPER MACHINE

CROSS-REFERENCE TO RELATED APPLICATION

This application claims the benefit of U.S. Provisional patent application Ser. No. 60/049,251 filed Jun. 10, 1997.

FIELD OF THE INVENTION

The present invention relates to papermaking machines, and more particularly relates to a device in a reel-up in a paper machine for applying an adhesive agent to the paper web when changing reels.

BACKGROUND OF THE INVENTION

In the last 15 years or so the speed of travel for tissue webs has not increased to any great extent and earlier developments as regards speed have evened out. This is considered to be a result of increasing demands for high-quality tissue and also of difficulties in maintaining the higher production speeds attained in other parts of the paper machine in its dry end also. These difficulties are caused, for instance, by increased vibration in the web at increasing speeds, and problems with web rupture encountered when threading while changing reels since tissue paper has low basis weight and low tensile strength.

Threading means that a web end is pulled along through a paper or cardboard machine by a leader consisting of a strip of the web which may initially be e.g., 400–500 mm wide but gradually becomes wider until it extends across the entire width of the web. The leader is cut out in the continuous web, starting either at one edge or somewhere at an optional distance from either edge of the web, whereas its length is determined by the time it takes for the tip to extend across the entire width of the web. Due to the high web speed the leader may be very long, 180–200 m, and this incurs considerable costs for the paper mill since the cut part of the paper web must be discarded for each paper reel. Threading can be performed with cords, compressed air or manually in machines running at low speed. Currently the safest and most efficient automatic threading means consists of a blower box which, with the aid of compressed air carries the leader to the nip between the new reeling drum and the surface winding drum.

Adhesive is often used, mixed with water to ensure that the leader adheres to a new reel core, or to the paper reel already started if a web rupture has occurred during reeling. The adhesive is applied either manually, using a large brush or spray gun, or automatically with the aid of glue nozzles, generally placed at one side of the paper web close to the primary arms. Serious safety aspects naturally arise as regards this manual application. Unsuccessful reel switching and the need to clean up after glue has been spilled during application, have a significant influence on the total capacity of the machine, particularly since the spilled glue forms lumps with the paper dust falling down as a result of machine vibrations and may thus constitute one of the reasons for web ruptures.

Sanitary tissue products, usually manufactured of tissue paper, are extremely market-sensitive and the quality of the product is therefore often more important than its quantity. It is thus important that during reeling the paper reel acquires several important properties, i.e., homogeneity and lack of wrinkles, tears or folds. Furthermore, high efficiency in the following conversion machines can only be achieved if the reels of paper from the paper machine have a homogenous high quality.

Soft paper with low strength must be reeled carefully in order to keep the paper qualities such as density and elasticity as constant as possible throughout the reel. The two main parameters affecting reel density are web tension and radial pressure at the nip of the reel-up. Lower nip pressure is important in order to obtain lower average density.

The thickness and elasticity decrease from the outside of the reel radially towards its center. This is because the compressive stress built up in the paper reel during reeling compresses the radially inner parts of the reel, thereby causing a loss of thickness in the inner web layers. This effect increases if the reel is stored for too long before being rewound or converted.

Reeling problems arise when a new reel of paper is commenced with the aid of the tapered leader as mentioned above, since the web turns applied during winding of the innermost layers produce uneven radial growth axially along the reeling drum so that the reel becomes carrot-shaped. This reeling problem is caused partly by superelevation of the web and partly by the carrot shape produced resulting in the nip-pressure profile across the web being greatly elevated at the transition point of the web section.

If the cross-sectional profile of the paper web differs as regards thickness, web tension or elasticity, as in the carrot shape described above, pleating, crushing damage, defects in the web and axial forces in the reel will occur at high nip pressure, which forces tend to displace the reeling axially along the reeling drum if the friction between the paper web and the reeling drum or the layers being applied is insufficient. This displacement may even in the worst case result in a web rupture, which is another reason for striving towards the lowest possible nip pressure. However, with low nip pressure, slipping may occur in the direction of rotation between the surface winding drum and the reeling drum, as well as between the web layers and contrary aims therefore arise concerning the magnitude of the nip pressure. Slipping in the direction of rotation may also occur at web ruptures since these cause the web to become slack as a result of reduced web tension.

The now prevalent use of central driving of the reeling drum, however, reduces the risk of rotational slipping since the reel is then not driven only by the frictional force transmitted through a high nip pressure. However, other problems arising out of the carrot shape remain and it would therefore be a considerable step forward if a well-functioning change of full-width reels could be performed instead which does not give rise to said carrot shape. Changing "full-width" reels in the present context refers to wrapping the entire width of the web around the reeling drum when initiating a new reeling operation. This is to be distinguished from threading using a tapered leader.

When changing reels the web must wrap around the new empty reeling drum, whether reel switching is performed by threading or using full-width transfer. At high web speeds glue is nowadays always applied on the leader, which constitutes the most efficient method hitherto for transferring the continuous web or switching reels. An exemplary device is disclosed in published European Patent Application No. EP 0 765 832 A2.

However, at low web speeds full-width wrapping by means of balloon-blowing is a relatively usual method. Briefly, this entails creating a slack across the full width of the web by somewhat retarding the finished reel. With the aid of compressed air, the fold thus formed is then forced into the nip between the new reeling drum and the surface winding drum, after which the web is cut off. In order to increase the reliability of this type of reel switching, glue or tape is also applied, but only on the actual reeling drum before this comes into contact with the paper web. The reason for this is explained below.

Regardless of the transfer method used for switching reels, it is extremely important that the glue is still adhesive when contact occurs between paper web and reeling drum. It is thus desirable to use the simultaneous and thus more reliable glue spraying for full-width reel switching as well. However, when applying glue by means of spraying, great care must be taken to avoid the glue being misdirected. In earlier attempts at full-width reel switching considerable problems have been encountered with the use of spray pipes across the machine direction because of the hitherto unavoidable and constant dripping of glue from the glue nozzles down onto the paper web below, causing the web layers to adhere to each other and the web to be torn during rewinding. This has prevented installation of glue nozzles across the continuous web and a few nozzles as close to the nip as possible have had to be used. To reduce the risk of glue drops, the glue is often still applied entirely manually, using a brush for instance, that the machine operator must carry with him. Thus, the main reason that automatic nozzles only function satisfactorily when switching reels with the threading method, but not with full-width reel switching, is that no efficient way has yet been found of spreading the glue to the middle of the web other than by manual application.

To enable reel switching at the considerably higher speeds now desired, the method usually used with threading must in some way be replaced by full-width reel switching. Attempts have been made to apply glue with the aid of travelling devices passed across the continuous web during reel switching. See, for example, U.S. Pat. No. 5,213,649. However, this method typically does not permit complete full-width reel switching since the high web speed still results in a slanting web end so that the undesirable carrot shape is obtained.

A key factor for efficient reel switching is thus the type of reel switching used. However, other important factors are control of the nip pressure and quality of the sleeve applied on the reeling drum. If a substandard sleeve, e.g., one with uneven thickness or strength, is pressed against the surface winding drum, the nip will be incompletely closed, sealing only at the places where the sleeve is thickest. The nip pressure must then be increased in order to completely close the nip, but the variations in compressive stress over the transverse profile still remain because of said differences in thickness in the sleeve. These pressure variations are of course greatly aggravated in the helical reeling resulting from threading.

The glue should preferably be applied as an aerosol since poorer result is obtained with a liquid jet. The nozzles are nowadays generally arranged on the primary arms, directed in towards the nip, since the first turns on a new reeling drum generally occur here. A correct nip pressure is most essential during the initial reeling while the reel is still held in the primary arms, since its own weight is then still acting in the direction of the nip. During the secondary reeling, on the other hand, the growing weight of the reel is taken up by the stand rails. Too high a nip pressure will risk crushing the first layers of paper wound on and the nip-pressure control in the primary arms is also extra critical since, because of the leader, the nip width is relatively narrow during the first turns. Glue is sprayed for a brief moment on two occasions, first to facilitate wrapping of the leader around a new empty reeling drum and then, if desired, to attach the opposite end of the web to the finished reel of paper when reel switching has been completed.

Another problem arising during reel switching when either a leader or a string of glue on only a small part of the paper web is used, is that the wrapping fold formed is too long. This wrapping fold occurs since only a small portion of the web width is glued to the new reeling drum, while the rest, constituting the majority, tends to fly off in the machine direction instead of wrapping around said reeling drum. For this reason balloon-blowing with compressed air is usually used to facilitate wrapping, although this unfavorably increases the number of machine parts in a critical area of the reel-up below the continuous paper web. It is thus a distinct end in itself to have as little transverse equipment as possible in the area around the roll nip, i.e., to minimize the number of machine parts both because of the complications arising at a web rupture when the paper web falls down onto said parts and because this facilitates service and repairs, for instance.

Thus, there exists a need in the art for a glue dispensing device which permits full-width changes of reels to eliminate the problems associated with tapered leaders outlined above. Such a device would preferably be operable at high machine speeds, and without risk of excess glue drops falling onto the middle or other portions of the web. Accordingly, full-width reel changes could be accomplished to improve reel quality and the tissue product thus formed.

SUMMARY OF THE INVENTION

The device according to the invention meets these and other needs and is characterized by a screen mounted on the stand of the reel-up, upstream of the surface winding drum or the continuous belt, and extending transversely to the machine direction. A spray rack is supported by the screen, extending transversely to the web across its entire width and comprising a plurality of nozzles distributed uniformly across the web to spread spray jets of liquid containing said adhesive agent onto the web to form a coherent adhesive area perpendicular to the machine direction. The adhesive area is brought into contact with an empty reeling drum or an already commenced reel of paper.

Using a glue-spreading device according to the invention avoids the necessity of applying the string of glue manually when performing full-width reel switching and the glue can be applied only where it is supposed to be, i.e., directly on the paper web without glue nozzles having to be arranged at unsuitable points, e.g., on the primary forks or the like. Thanks to this, and the drip-free design of the nozzles which contain a cleaning needle that effectively closes the tip of the nozzle, greatly increased web speed can be maintained. Another advantage of the glue-spreading device is its positive aerodynamic effect on the web passage as regards vibration and "flutter" in the paper web up to the roll nip obtained by the location of the glue-spreading device.

The invention will be explained in more detail in the following with reference to the drawings.

DETAILED DESCRIPTION OF THE INVENTION

Figure 1:
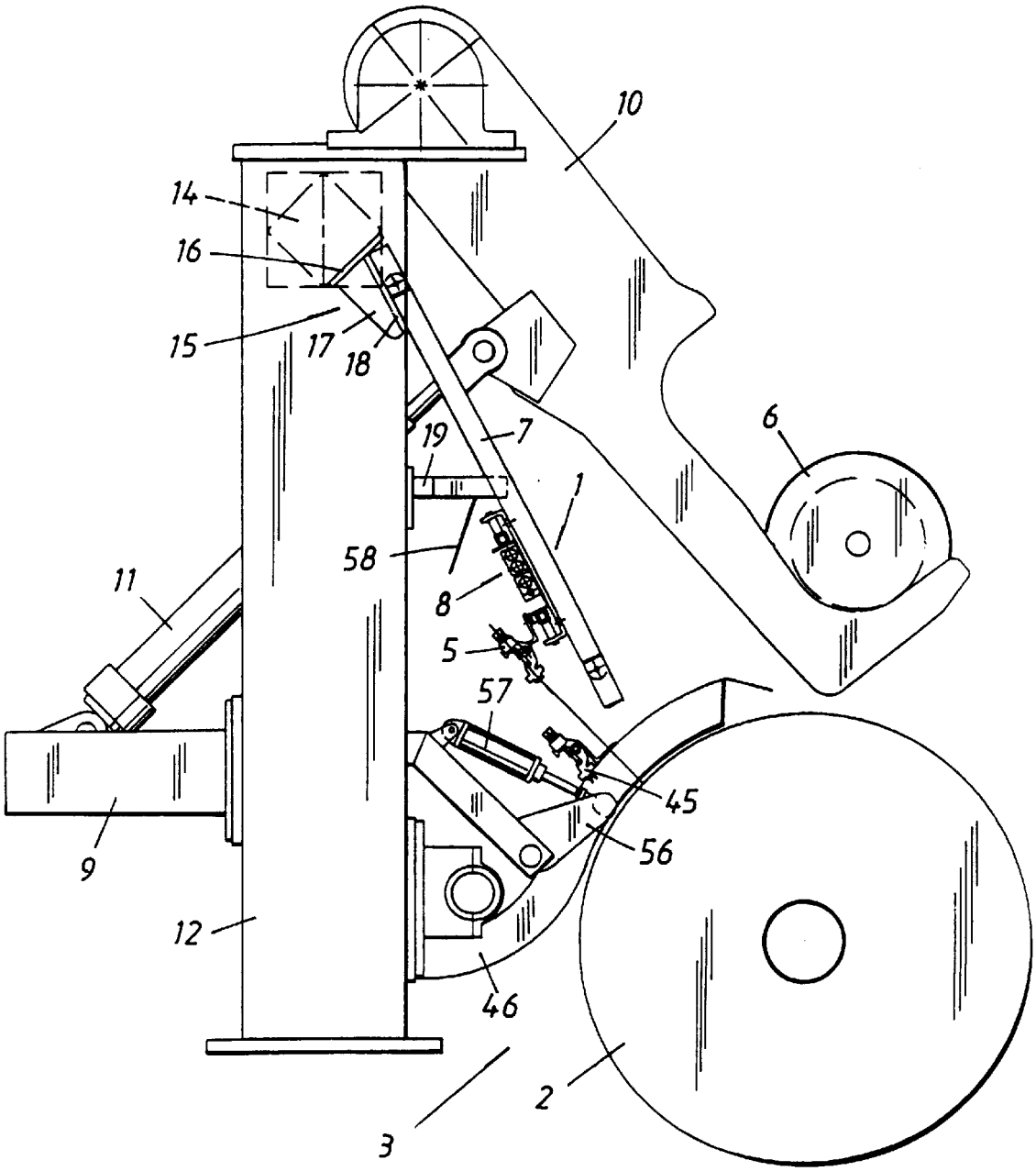
FIG. 1 is a schematic side view of parts of a reel-up according to the invention seen from one long side, the operator side of the reel-up, showing the glue-spreading device with a spray rack.
Figure 2:
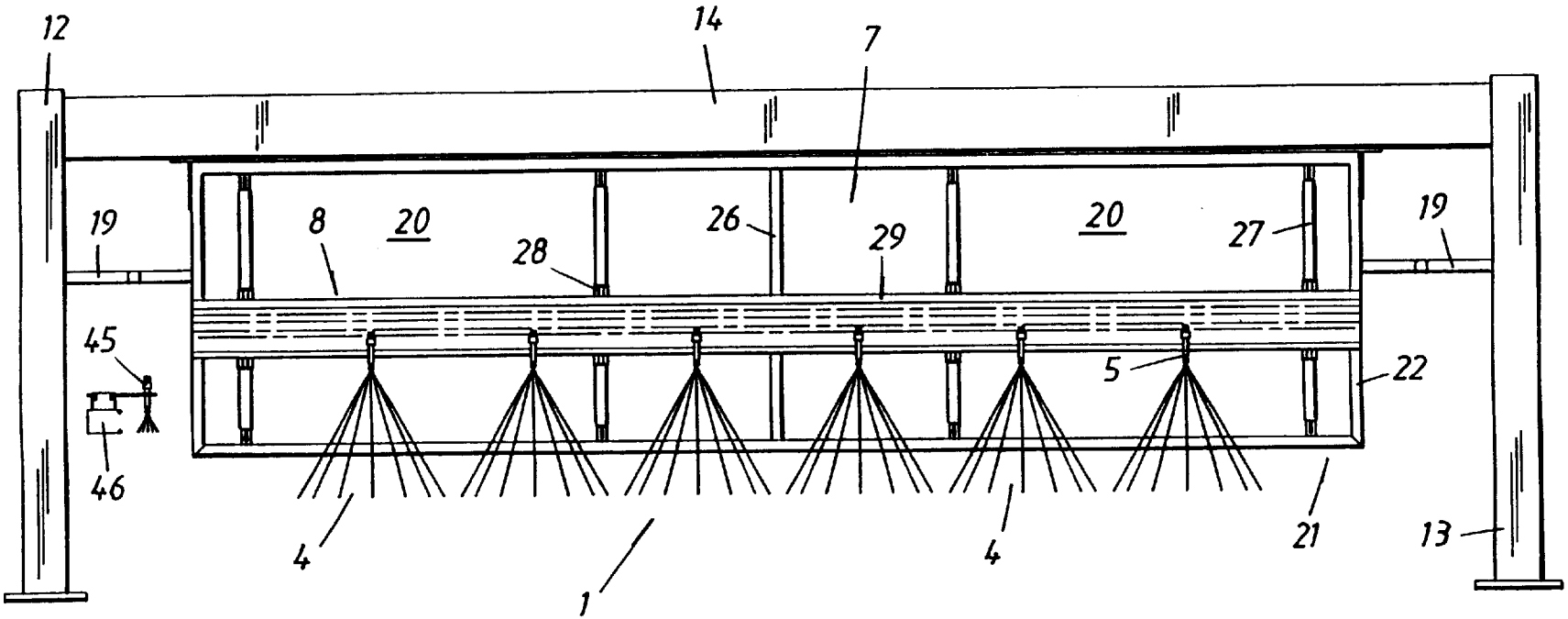
FIG. 2 shows a view of the glue-spreading device according to FIG. 1, seen from the upstream end of the reel-up.

FIGS. 1 and 2 show schematically a preferred embodiment of a glue-spreading device 1 according to the invention, arranged upstream of a rotatable winding surface such as a surface winding drum 2 in a reel-up 3 of a paper machine. A winding belt could be used in place of the winding drum 2. When performing full-width reel switching it is possible according to the invention to use some form of adhesive spray liquid, preferably glue, across the continuous paper web so that the whole width of the paper web is covered by jets 4 from nozzles 5 mounted in the glue-spreading device 1, thereby attaching a web end either to a new reeling drum 6 or to a paper reel. The glue-spreading device 1 comprises essentially two parts arranged transversely to the machine direction, namely a box-like screen 7 constituting the supporting frame of the glue-spreading device 1, and a spray rack 8 which is adjustable in both vertical and horizontal direction to a width and a distance adjusted to the continuous paper web.

Said box screen 7 is mounted on the stand 9 of the reel-up 3, on which stand the lowering arms 10 including their actuators 11 are also mounted, see FIG. 1. As can be seen in FIG. 2, the stand 9 comprises two vertical pillars 12, 13, between the upper ends of which a horizontal beam 14 extends across the continuous paper web. Said box screen 7 is preferably rigidly mounted by means of a plurality of attachment devices 15 in the stand 9 of the reel-up 3 in the upper end of the box screen 7 and at each of its vertical short sides. In the embodiment shown, see FIGS. 1 and 2, said attachment devices 15 consist of an attachment plate 16 welded to the horizontal beam 14 with a support in the form of a bracket 17 protruding from the plate and preferably welded to a reinforcing plate 18 with a specific extension downwards from the upper edge of the box screen 7, and also at least one attachment beam 19 extending preferably horizontally between the pillars 12, 13 and the adjacent vertical short side of said box screen 7 to brace this in the lateral direction. In another embodiment, not shown, the box screen may be movably arranged on the reel-up stand by means of some type of actuator able to move or swing the glue-spreading device to any desired position in relation to the surface winding drum 2.

Depending on the width of the paper web, the box screen 7 comprises at least one, preferably several, thin, identical box sections 20 or panels arranged side by side, see FIG. 2. In the embodiment shown each separate box section 20 consists of a rectangular frame 21 constructed of at least two vertical and two horizontal rods 22 of U-sections, I-sections or rectangular sections, suitably of steel, welded together at their ends to said frame 21. Diagonal bracing can also be arranged if necessary.

The frame 21 has thin covering plates 25 (see FIG. 4) at its upstream and downstream sides 23, 24, said covering plates 25 being riveted, welded or secured in some other suitable way to the frame 21. This attachment may be over the whole or part of each side 23, 24 in order to form said thin box section 20. The term "screen" is intended to be used in its broadest sense (which would, for example, include the term "shield") and should not be construed as being limited to a mesh-like structure. In addition to supporting the spray rack 8, the upstream side of the screen advantageously functions to baffle any dust-laden air currents attendant to the travelling web. The downstream side prevents any portions of the web, such as a tail or a ruptured portion, from fluttering back in the upstream direction in the event a turn-up operation is not successful.

Each box section 20 is connected to the next box section by means of the intermediate, common, vertical joint 26 with the aid of suitable means, e.g., screw joints. Between the two horizontal parts of the frame 21 extend a plurality of vertical bars 27 for adjustment of the spray rack 8 in vertical directions. This adjustment is suitably achieved by some form of displacement device or attachment device 28, e.g., a screw joint, securing the spray rack 8 in desired position on the vertical bars 27.

Figure 3:
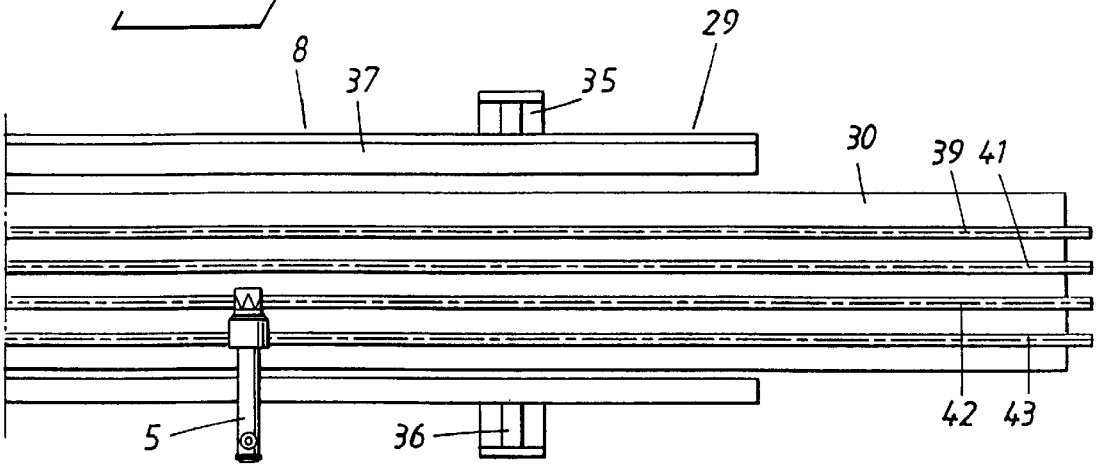
FIG. 3 is a view of a part of the spray rack according to FIG. 1, seen from its upstream end.
Figure 4:
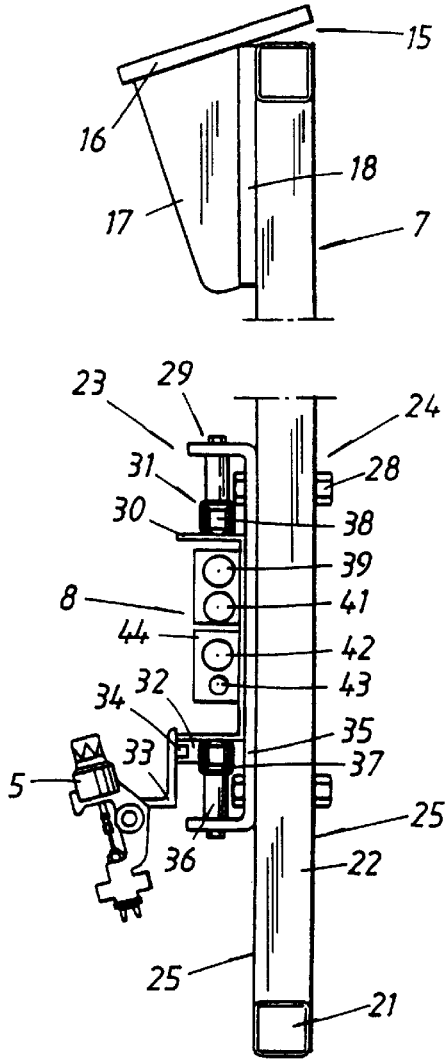
FIG. 4 is an enlarged view of the glue-spreading device according to FIG. 1.

The spray rack 8, see FIGS. 3 and 4 comprises a rail frame 29 mounted with the aid of the attachment devices 28 to said vertical bars 27, and one or more assembly rails 30 arranged to be telescopically movable in the rail frame 29. In the embodiment shown, each assembly rail 30 consists of a U-section, see FIG. 4, which can be moved horizontally by means of upper and lower bearing means 31 so that said assembly rails 30 with the nozzles 5 thereon can be first roughly adjusted in relation to the position of the paper web and can also be pulled out completely on both the drive side and the operator side of the reel-up 3 for cleaning and service of the internal parts of the glue-spreading device 1.

Besides said rough adjustment a second, finer adjustment of the lateral position of the nozzles 5 is also possible since each nozzle 5 is also displaceable in a fine-adjustment strip 32 arranged below the assembly rail 30. This fine-adjustment strip consists suitably of an aluminum section, for instance, with a horizontal groove in which the mounting device of the nozzle 5 can slide, said mounting device being attached to a block 34 of polytetrafluoroethylene, for instance.

Said rail frame 29 is made of a number of vertically arranged U-brackets 35 comprising an upper and a lower shank, mounted on the vertical bars arranged at regular intervals along the box screen 7, in the manner described above. A spacer 36 extends inwardly from each shank towards the center of the U-bracket 35, which is advantageously threaded at both ends for its attachment. Two parallel, horizontal rail fillets are mounted in the free end of these spacers 36 to extend the full length of the box screen 7. Cooperating with the bearing means 31 mentioned above, each rail fillet constitutes a support for the assembly rail 30 horizontally displaceable in the rail frame 29. The bearing means 31 comprise a plurality of travelling devices 38 which are permanently arranged on the upper and lower edges of the assembly rail 30 and run in a groove open to the U-brackets 35 in inside each rail fillet 37, thereby enabling the assembly rail to be displaced telescopically. The travelling devices 38 suitably comprise some form of roller or slide means, e.g., a roller, track wheel or block of polytetrafluoroethylene.

In the embodiment shown a pipe system is also arranged on the assembly rail 30, said system comprising four separate, parallel pipes. These consist of a pipe 39 for compressed-air control of a cleaning needle 40 arranged in each nozzle 5, as described in more detail below, a compressed-air pipe 41 for atomizing the glue, a glue-inlet pipe 42 and a glue outlet in the form of a return pipe 43 for the required circulation of the glue. Retainers 44 for the pipes 39, 41, 42, 43 are also arranged on the assembly rail 30. In the embodiment shown in FIG. 4 these retainers consist of two pipe clamps placed along the assembly rail 30, a suitable distance one above the other, each retaining two pipes 39, 41 and 42, 43, respectively.

In the embodiment shown in FIG. 2 the spray rack 8 is equipped with six nozzles 5 for spreading glue for full-width wrapping, these nozzles 5 being evenly distributed across the whole width of the paper web. An additional nozzle 45 is also provided, mounted on a blower box 46 fitted on the drive side of the reel-up 3 to spread glue on the leader when a web rupture has occurred and said leader must once more be threaded and guided with the aid of said blower box 46. All the nozzles 5, and also the nozzle 45 in the blower box 46, are adjustable to a desired and optimal position in relation to the surface winding drum 2 and the paper web running over this, by means of the assembly means 33 arranged on the spray rack 8 and the blower box 46 so that the point of encounter and thus the pattern of contact on the paper web can be varied. The assembly means 33 are therefore both pivotable so that the angle of incidence of the jet of glue towards the center of the surface winding drum 2 can be finely adjusted, and also vertically adjustable a short distance. The nozzles 5 in the embodiment described consist of automatic, air-operated nozzles 5 which mix air and liquid, preferably in the form of a glue suspension, which is applied on the paper web under high pressure in the form of a finely distributed jet of glue 4.

Each nozzle 5 is supplied with glue through the glue inlet pipe 42 arranged on the assembly rail 30, with the aid of a compressed-air operated piston pump 50 described below, the nozzles 5 also comprising special supply members, suitably flexible tubes (not shown), for the compressed air needed in a pneumatic cylinder 60 for operation of the main functions of the cleaning needle 40, and also for atomization of the glue suspension.

Figure 5:
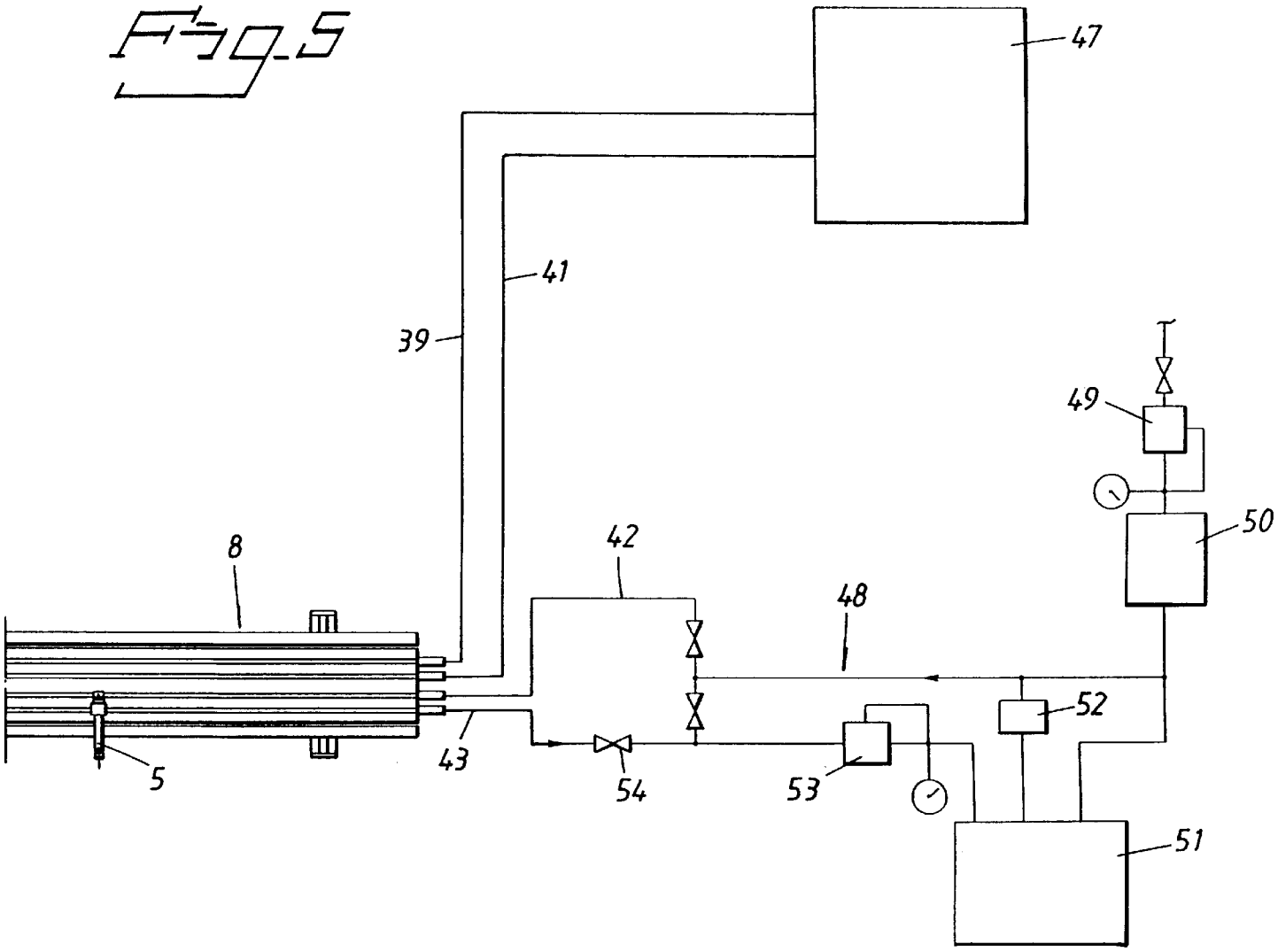
FIG. 5 is a block diagram of a glue-circulation system for the spray rack according to FIG. 1.

A glue circulation system 48 is connected to the glue-spreading device 1 to enable circulation of the glue so that it is prevented from drying, as described with reference to FIG. 5. The glue circulation system 48 and a valve cubicle 47 connected thereto, suitably include one or more air pressure regulators 49, pumps 50, glue tanks 51 containing a synthetic polymer glue in water, for instance, safety valves 52, glue-pressure regulators 53, non-return valves 54, pressure accumulators, pressure transducers and finally, the elements on the spray rack 8 described earlier. In the embodiment described the glue circulation system 48 may be controlled manually and/or automatically from a control panel, not shown, comprising three main functions, namely: application of glue on a leader which, as described above, is only performed in manual mode and when a web rupture has occurred, application of glue manually or automatically across the full width of the web during reel switching and cleaning of respective nozzles 5, this being effected by blowing only compressed air for a moment through respective outlet nozzles 55. The glue is kept constantly circulating in a closed circuit consisting of pipes between the glue-spreading device 1 and the glue tank 51. The spray rack 8 and the single nozzle 45 for the threading are controlled entirely separately from each other by means of a pneumatic control system. All valves comprising the non-return valves 54 and the separate electromagnetic valves arranged at each nozzle 5 are connected to a control unit together with respective pumps 50 and other parts essential to the glue-spreading device 1.

FIG. 1 also shows a web support 56 extending transversely across the continuous web, said web support 56 comprising at least one actuator 57 for its operation from a first, passive position folded up during the transition when switching reels, to a second, active position, folded down after completion of the reel switch. Said web support 56 serves as an extra protection against dripping glue and also to control the continuous paper web during the air turbulence that always arises close to the nip between the reeling drum 6 and the surface winding drum 2.

FIG. 1 also shows a dust cover 58 arranged on the upstream side 23 of the box screen 7, said cover suitably being rigidly mounted just above the spray rack 8 at its upper horizontal edge. The dust cover 58 consists, for instance, of a bent plate extending from said side at a specific angle so that the spray rack 8 is screened from dust coming from the parts of the reel-up 3 situated upstream. Undesired air currents are thus reduced to a minimum and the effect of dust suction boxes, not shown, situated upstream is improved.

The spray liquid supplied to the glue-spreading device 1 may consist of a surface-active agent, water or a suspension or dispersion consisting of adhesive agent, a suitable solvent and a carrier, preferably water in order to avoid patches being formed.

The glue-spreading device 1 may also be equipped with two separate pipe systems for increased reliability, a programmable control unit controlling each nozzle 5 individually, a panel display and equalization container for said glue circulation system 48. All of the above-mentioned components are mounted in suitable manner which may entail gluing, welding, screwing or riveting, for instance.

Figure 7:
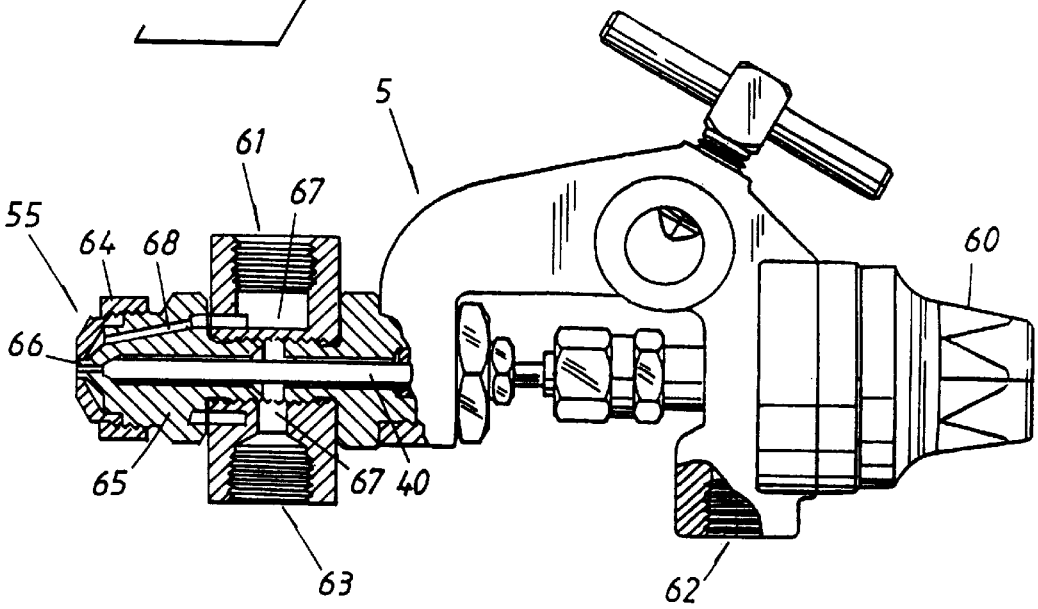
FIG. 7 is a view of a nozzle for the glue-spreading device according to FIG. 1, partially in cross section.

Referring to FIG. 7, the nozzles 5 also include the following additional important components: said cleaning needle 40 with associated actuator in the form of a pneumatic cylinder 60 for operation of the cleaning needle, three coupling devices 61, 62, 63 for the flexible connection hoses described below, the outlet nozzle 55 which in the embodiment shown in fact consist of an outer and an inner nozzle 64, 65 arranged one after the other, the outer nozzle 64 being intended for compressed air and the inner nozzle 65 for the glue dispersion, an outer channel 66 for said glue dispersion, and the assembly means 33 with associated adjustment means as described above. Three flexible connection hoses (not shown) are drawn from the pipes 39, 41, 42 on the assembly rail 30, from the two compressed-air pipes 39, 41 and from the glue inlet pipe 42, each to its own coupling device 61, 62, 63 on respective nozzles 5. Nozzles are preferably used which give a finely distributed flat spray in the shape of a fish tail, i.e., with large width but slight thickness.

Figure 6:
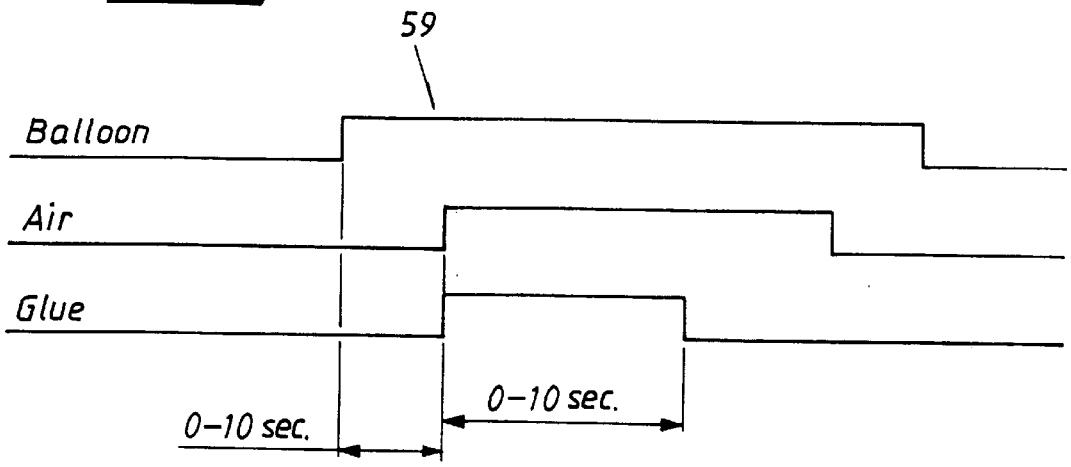
FIG. 6 is a sequence diagram showing the spreading process in relation to time in the glue-spreading device according to FIG. 1.

The function of the glue-spreading device 1 is described below with reference to a sequence diagram 59 shown in FIG. 6. In auto mode gluing is performed as an automatic full-width reel switch, together with balloon blowing. The sequence 59 commences with the finished paper reel being temporarily retarded so that a slack is created, the slack extending across the full width of the paper web. The web fold thus formed is forced by means of compressed air into the nip between the new empty reeling drum 6 applied by the lowering arms 10 and the surface winding drum 2.

Application of the glue can be started 0–10 seconds after commencement of the sequence, whereupon the cleaning needle 40 is moved by its actuator 60 to its rearmost position in the nozzle 5, thereby providing free passage to the nozzle 5 itself, for the glue suspension and the atomizing compressed air, so that they are sprayed out synchronously from the outlet 55 of the nozzle 5. An aerosol mist 4 is thus applied over the whole paper web in a predetermined pattern. The atomization of the liquid 4 is determined by varying the magnitude of the compressed air flow while keeping the liquid flow constant. The glue application sequence 59 is preferably such that the compressed-air valve to the atomization air is opened first and closed last, preferably about 6 seconds after the glue supply, lasting approximately 0–10 seconds, has been cut off. The nozzles 5 are both operated and cleaned with the aid of compressed air so that they are self-servicing. The cleaning needle 40 cleans said outlet channel 66 mechanically so that the glue dispersion can be freely fed out through the outlet nozzle 55 without risk of clogging, as well as closing the outlet channel 66 of the nozzle 5 completely after each gluing procedure. The coupling device 61 for the atomizing compressed air is provided with a separate short connection channel 68 to said outer outlet nozzle 64 to enable the outlet channel 66 to be blown clean in the manner described above. Thanks to this construction the nozzle 5 is completely drip-free.

The outlet nozzles 55 of the nozzles 5 may be changed depending on the desired pattern of contact and are fitted entirely separately from the pneumatic cylinder 60 and cleaning needle 40, outermost on the nozzle 5 to minimize maintenance. The application process for the glue-spreading device 1 may suitably be synchronized with a slitter, not shown, for cutting the web.

What is claimed is:

1. A reel-up for reeling a web of fibrous material into reels on exchangeable reeling drums, said reel-up comprising:

a stand for supporting at least one of the reeling drums;

a rotatable winding surface adjacent to the stand for pressing the advancing web against the reeling drum and causing the web to be wound thereon;

a screen mounted to the stand adjacent to the web at a position upstream of the reeling drum and at an orientation generally transverse to the advancing web and associated air currents;

a spray rack supported by the screen and extending transversely across the web; and a plurality of spray nozzles mounted along the spray rack for spraying an adhesive agent onto the web in a pattern which extends in a direction across the web.

2. A reel-up as claimed in claim 1 wherein said screen further comprises a framework made up of one or more panels.

3. A reel-up as claimed in claim 2 wherein said screen further comprises one or more plates covering at least a portion of the framework.

4. A reel-up as claimed in claim 2 wherein said framework defines an upstream side and a downstream side relative to the moving web and further wherein said spray rack is mounted to the upstream side of the framework.

5. A reel-up as claimed in claim 4 further comprising a separate dust cover mounted on the upstream side of the screen framework above the spray rack.

6. A reel-up as claimed in claim 1 wherein said spray rack further comprises:

a horizontal rail frame affixed to the screen; and at least one assembly rail for supporting the spray nozzles, said assembly rail being displaceably journalled in the rail frame for adjustment relative to the web in the cross machine direction.

7. An adhesive-dispensing device in a web reel-up for applying an adhesive agent to the web before the web is wound onto a reeling drum, said device comprising:

a screen mounted on the reel-up adjacent to the web at a position upstream of the reeling drum and at an orientation generally transverse to the advancing web and associated air currents;

a spray rack supported by the screen and extending transversely across the web; and a plurality of spray nozzles mounted along the spray rack for spraying an adhesive agent onto the web in a pattern which extends in a direction across the web.

8. A device as claimed in claim 7 wherein said spray rack further comprises:

a horizontal rail frame affixed to the screen; and at least one assembly rail for supporting the spray nozzles, said assembly rail being displaceably journalled in the rail frame for adjustment relative to the web in the cross machine direction.

9. A device as claimed in claim 8 wherein said assembly rail is configured to be removable from either end said rail frame.

10. A device as claimed in claim 8 wherein each of the spray nozzles is displaceably journalled in the assembly rail for fine adjustment of the horizontal position of the nozzle in relation to the web.

11. A device as claimed in claim 8 wherein each of the spray nozzles is pivotably and vertically displaceably mounted in the assembly rail for adjustment of the angle and distance of the spray jet in relation to the web.

12. A device as claimed in claim 8 wherein the nozzles are air-driven for mixing compressed air and the adhesive agent to thereby create a spray.

13. A device as claimed in claim 12 further comprising a pipe system supported on said assembly rail, said pipe system including:

a compressed-air pipe connected to each nozzle for operating a cleaning needle arranged therein;

a compressed-air pipe connected to each nozzle for atomization of the adhesive agent;

an inlet pipe connected to each nozzle for supplying the adhesive agent; and an outlet pipe connected to each nozzle for removing unused adhesive agent.

14. A device as claimed in claim 7 wherein said screen further comprises a framework made up of one or more panels.

15. A device as claimed in claim 14 wherein said screen further comprises one or more plates covering at least a portion of the framework.

16. A device as claimed in claim 14 wherein said framework defines an upstream side and a downstream side relative to the moving web and further wherein said spray rack is mounted to the upstream side of the framework.

17. A device as claimed in claim 16 further comprising a separate dust cover mounted on the upstream side of the screen framework above the spray rack.

18. A reel-up for reeling a web of fibrous material into reels on exchangeable reeling drums, said reel-up comprising:

a stand for supporting at least one of the reeling drums;

a rotatable winding surface adjacent to the stand for pressing the advancing web against the reeling drum and causing the web to be wound thereon;

a spray rack supported by the stand and extending transversely across the web;

a plurality of spray nozzles mounted along the spray rack and over the web for spraying an adhesive agent onto the web, said spray nozzles being selectively closable to stop the flow of adhesive agent;

an inlet line for supplying the adhesive agent to the spray nozzles; and an outlet line for removing unused adhesive agent from the spray nozzles to prevent any adhesive agent from falling unintendedly onto the web after the nozzles have been closed.

19. A reel-up as claimed in claim 18 further comprising:

a supply tank containing a supply of adhesive agent which is connected to both the inlet line and the outlet line; and a pump for continuously circulating adhesive from the supply tank to the nozzles through the inlet line and further back through the outlet line when the nozzles are closed.

20. A reel-up as claimed in claim 18 wherein each spray nozzle is independently closable such that a selected portion of the width of the web can be sprayed with adhesive.

21. A reel-up as claimed in claim 18 wherein the spray nozzles each further comprise a cleaning needle.

22. A reel-up as claimed in claim 18 wherein said spray rack further comprises:

a horizontal rail frame supported on the stand; and at least one assembly rail for supporting the spray nozzles, said assembly rail being displaceably journalled in the rail frame for adjustment relative to the web in the cross machine direction.

23. A reel-up as claimed in claim 22 wherein said assembly rail is configured to be removable from either end said rail frame.

24. A reel-up as claimed in claim 22 wherein each of the spray nozzles is displaceably journalled in the assembly rail for fine adjustment of the horizontal position of the nozzle in relation to the web.

25. A reel-up as claimed in claim 22 wherein each of the spray nozzles is pivotably and vertically displaceably mounted in the assembly rail for adjustment of the angle and distance of the spray jet in relation to the web.

26. A reel-up as claimed in claim 22 wherein the nozzles are air-driven for mixing compressed air and the adhesive agent to thereby create a spray.

27. A reel-up as claimed in claim 26 further comprising a pipe system supported on said assembly rail, said pipe system including:

a compressed-air pipe connected to each nozzle for operating a cleaning needle arranged therein;

a compressed-air pipe connected to each nozzle for atomization of the adhesive agent;

an inlet pipe connected to each nozzle for supplying the adhesive agent; and an outlet pipe connected to each nozzle for removing unused adhesive agent.

* * * * *